United States Patent [19]

Welsch et al.

[11] 4,237,798

[45] Dec. 9, 1980

[54] ADJUSTABLE SHELVING

[75] Inventors: John H. Welsch, Moscow; Charles W. Nicely, Dallas, both of Pa.

[73] Assignee: Metropolitan Wire Corporation, Wilkes-Barre, Pa.

[21] Appl. No.: 26,831

[22] Filed: Apr. 4, 1979

[51] Int. Cl.[3] ..... A47B 9/08

[52] U.S. Cl. ..... 108/111; 108/144; 248/188

[58] Field of Search ..... 108/144, 111; 403/234, 403/235, 217, 188, 199; 211/189; 248/188

[56] References Cited

U.S. PATENT DOCUMENTS

| | | | |
|---|---|---|---|
| 3,203,374 | 8/1965 | Gingher et al. | 108/144 |
| 3,874,511 | 4/1975 | Maslow | 108/144 X |
| 3,915,101 | 10/1975 | Onori | 108/111 |
| 3,964,404 | 6/1976 | Mueller et al. | 248/188 X |
| 4,132,178 | 1/1979 | Mueller et al. | 248/188 X |

*Primary Examiner*—Francis K. Zugel

*Attorney, Agent, or Firm*—Friedman, Goodman & Teitelbaum

[57] ABSTRACT

A flat shelf having truncated corners with a corner connector disposed against each truncated corner. The corner connectors tightly clamp onto corner support posts to retain the shelf in an elevated position. Each corner connector includes a brace member having a recess at its rear end for receiving one truncated corner, and a base wall within the recess for abutting against the truncated corner. A receiving pocket is provided at the front of the brace member for receiving the legs of a U-shaped clamp. The upper and lower walls of the brace member include aligned arcuate seats, which in conjunction with a bight portion of the clamp, define a sleeve which is tightenable around its associated corner support post. Bolts are inserted through the truncated corners to tighten the clamps around the corner support posts and securely retain the corner connectors against the truncated corners to thereby provide substantially closed crevice-free corner connectors.

25 Claims, 21 Drawing Figures

ADJUSTABLE SHELVING

BACKGROUND OF THE INVENTION

This invention relates generally to shelving and more particularly to a novel construction for adjustable shelving which provides substantially closed, crevice-free connections with associated corner support posts.

Adjustable metal shelving is well known. Typically, such shelving is of the so-called "knock down" type whereby the shelving can be easily assembled and adjusted as desired. Such shelving is typically a flat metal shelf with corner portions, and includes some type of corner connections to interconnect and hold the shelving onto corner support posts.

In many types of adjustable shelving arrangements, the corner connections are formed integrally with the shelf and include corner supports which can receive and securely clamp onto corner support posts. In order to provide a tight arrangement, a frustroconical member is inserted into the corner supports with a narrower section on the top and a wider section on the bottom. These frustroconical members fit into the corner supports and clamp onto the corner posts. One such typical arrangement is described in U.S. Pat. No. 3,424,111 as well as its continuation-in-part U.S. Pat. No. 3,523,508.

Another type of adjustable shelving includes a flat metal shelf with corner portions. Separate corner connectors are attached to these corner portions. The corner connectors include an arrangement to receive the corner posts. By way of example, one such arrangement is described in U.S. Pat. No. 3,874,511. In this latter arrangement, the shelf includes truncated corners with corner connectors clamped onto the truncated corner. Each corner connector includes a frustroconical shaped hole which receives a sleeve mounted on a corner post to securely retain the shelf on the corner posts.

In order to provide adjustability to the shelving, there are typically included various engaging relationships between the corner posts and the corner connectors whereby there are a plurality of spaced apart indentations on the post defining different vertical positions for the shelving. A projection is formed on each corner connector which can engage into the respective indentations and retain the shelving at the desired vertical position along the corner posts.

One of the problems with the prior art adjustable shelving, concerns the complexity of the corner connector arrangement. Typically, there are numerous crevices, corners, and open joints between the shelf, the corner connectors, and the posts. In order to eliminate the open joints and crevices which can collect dirt, complex arrangements are necessary, such as in the aforedescribed patents. For example, utilization of the frustroconical sleeve with interlocking sections as described in the aforementioned patents is an extremely costly clamp arrangement which requires a very large capital investment, and increases the cost of the shelving.

A very effective method of joining the shelves to the corner posts would be the utilization of a simple U bolt. However, a U bolt when in proper relationship to a corner post, forms a valley which is readily available for collection of dirt. This is especially objectionable when the shelving is to be utilized in connection with food or hospital services, or other places requiring sanitary conditions. Thus, the valleys and crevices between the U bolts, the corner posts, and the shelves, which are readily available for collection of debris and dirt, provide unsanitary and unacceptable conditions. Furthermore, such shelving must be readily adjustable and easily disassembled, and it should also provide sufficient support for heavy duty usage.

SUMMARY OF THE INVENTION

It is accordingly an object of the present invention to provide adjustable shelving which avoids the aforementioned problems of prior art devices.

Another object of the present invention is to provide adjustable shelving which is simple in construction, economical to manufacture, and avoids the problem of open joints, valleys, and crevices which can collect debris and dirt.

A further object of the present invention is to provide adjustable shelving which can be positioned and clamped onto corner posts.

Yet another object of the present invention is to provide adjustable shelving which can be inexpensively constructed of readily available parts necessitating only a minimum number of members to the complete assembly.

A further object of the present invention is to provide adjustable shelving having truncated corners with a brace coupled to each truncated corner for receiving a clamp which can tightly fit around a corner post.

Still a further object of the present invention is to provide adjustable shelving which includes a clamp and brace arrangement at the corners for forming a sleeve that tightly fits around a corner post.

Yet another object of the present invention is to provide a corner connector which can be mounted onto the corner portions of shelving and which avoids any open joints to thereby eliminate the collection of dirt.

Another object of the present invention is to provide adjustable shelving utilizing a U-bolt arrangement to clamp around a corner post for retaining the shelving onto the corner post and avoids the usual valleys, crevices, and openings to collect dirt.

Briefly, the present invention provides for shelving including a flat shelf member having downwardly depending corner portions. A corner connector is located at each corner portion. The corner connector includes a brace member and U-shaped clamp. The brace member has a base wall which is disposed against the outside surface of the corner portion. The brace member also includes a receiving pocket at its front end. Upper and lower walls are positioned with respect to the receiving pocket. Aligned arcuate seats are formed in the upper and lower walls. The U-shaped clamp has two spaced apart legs which can be received in the pocket. The bight portion of the clamp, together with the aligned arcuate seats, define a sleeve for fitting around the corner support posts. Fastening members tightly pull the legs of the clamp into the pocket to thereby clamp the sleeve about the post. At the same time, the fastening members tighten the brace member in abutment against the corner portion to retain the shelf in position on the posts.

In an embodiment of the invention, the shelf has truncated corners and a peripheral lip surrounds the base wall of the brace member to define a recess for receiving the truncated corner. The upper and lower walls are substantially horizontal and the upper wall of the U-shaped clamp is also substantially horizontal. The height and width of the clamp substantially corresponds to the height and width of the receiving pocket. In this manner, crevices and open joints are substantially avoided.

In a further embodiment of the invention, the corner support posts have vertically spaced apart indentations. At least one of either the clamp or brace member includes an outwardly extending projection which is engageable within any one of the indentations to thereby define selectable vertical positions for the shelf along the corner posts.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which:

FIGS. 6–8 show a first embodiment of the adjustable shelving arrangement, wherein FIG. 6 is a perspective view of a modified U-shaped clamp, FIG. 7 is a side sectional view showing the interconnection between such a clamp and a post, and FIG. 8 is a sectional view taken along line 8—8 of FIG. 7;

FIGS. 9–11 show a second embodiment of the adjustable shelving arrangement, wherein FIG. 9 is a perspective view of another modified U-shaped clamp, FIG. 10 is a side sectional view showing such a clamp connected to a post, and FIG. 11 is a sectional view taken along line 11—11 of FIG. 10;

FIGS. 12–14 show a third embodiment of the adjustable shelving arrangement, wherein FIG. 12 is a perspective view of a further modified U-shaped clamp, FIG. 13 is a side sectional view showing such a clamp positioned on a corner post, and FIG. 14 is a sectional view taken along line 14—14 of FIG. 13;

FIGS. 15–17 show a fourth embodiment of the adjustable shelving arrangement, wherein FIG. 15 is a perspective view of a modified brace member, FIG. 16 shows such a brace member interconnected onto a corner post, and FIG. 17 is a sectional view taken along line 17—17 of FIG. 16;

FIGS. 18–20 show a fifth embodiment of the clamping arrangement, wherein FIG. 18 shows a perspective view of another modified brace member, FIG. 19 shows such a brace member interconnected onto a corner post, and FIG. 20 is a sectional view taken along line 20—20 of FIG. 19.

In the various figures of the drawing, like reference characters designate like parts.

DETAILED DESCRIPTION OF THE PREFERRED EMBODIMENTS

Figure 1:
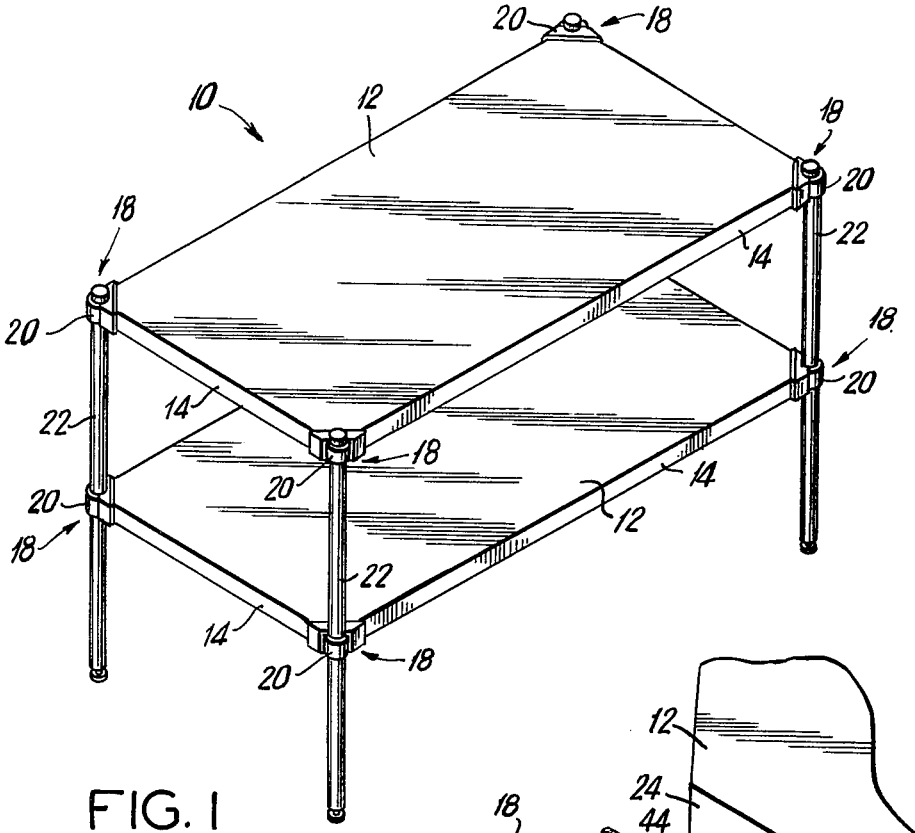
FIG. 1 is a perspective view of the adjustable shelving in accordance with the present invention.
Figure 3:
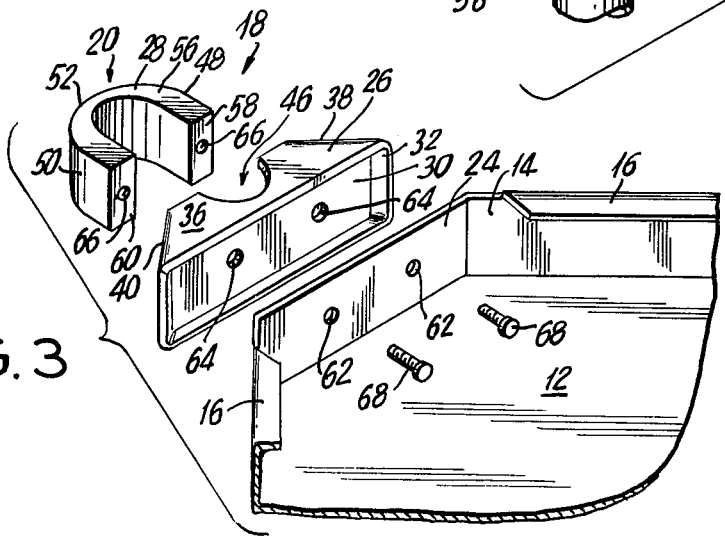
FIG. 3 is another exploded view of a corner portion of the adjustable shelving shown in FIG. 1, showing a bottom view thereof.

Referring now to FIG. 1, the adjustable shelving in accordance with the present invention is shown generally at 10, and includes at least one substantially flat shelf 12 having a generally rectangular configuration. Downwardly depending from the shelf are skirts 14 provided peripherally around the outer edges of the shelf. As best shown in FIG. 3, there are inwardly projected flanges 16 at the lower edges of the skirts 14.

At each corner of the shelf, there is provided a corner connector assembly 18 which includes a corner connector 20 which can clamp onto the corner support posts 22, and at the same time attach onto the corner of the shelf 12. The corner connectors permit the shelf to be adjustable along the corner support posts 22.

Figure 2:
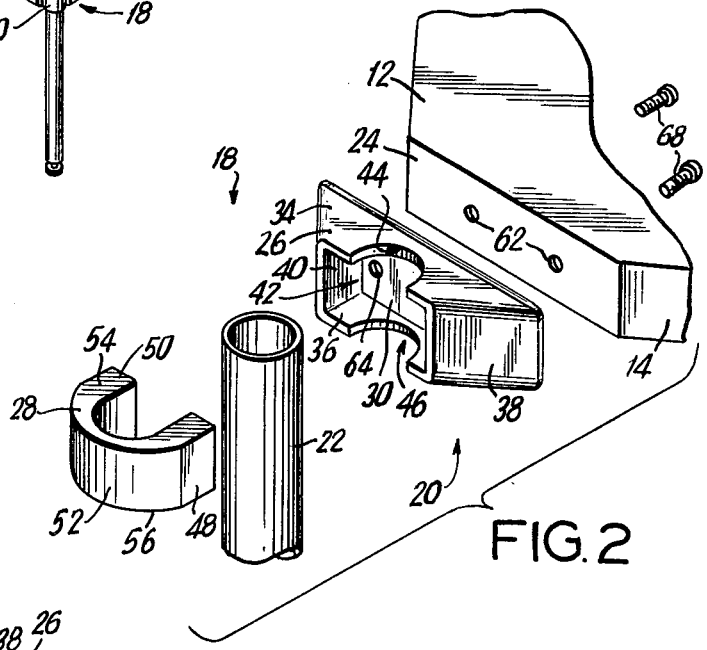
FIG. 2 is an exploded view of a corner portion of the adjustable shelving shown in FIG. 1, showing a top view thereof.

As can best be seen in FIGS. 2 and 3, the shelf includes truncated corners having a truncated face 24 interconnecting adjacent sections of the skirts 14.

The corner connectors 20 include a brace member, shown generally at 26, and a U-shaped clamp member, shown generally at 28. The brace member 26 includes a base wall 30 of substantially rectangular configuration which is equal in size to the truncated face 24. An outwardly extending peripheral lip 32 defines a recess at the rear of the brace member with the base wall 30 disposed at the rear of the recess. The truncated face 24 is received within the recess whereby the base wall abuts against the truncated face. For achieving close contact, the skirt flanges 16 terminate a spaced distance from the truncated corner to permit the lip 32 to extend over the truncated face 24. Obviously, the above mentioned recess at the rear of the brace member can be modified so that the lip 32 extends only on three sides thereof, where the bottom extending portion of the lip 32 can be eliminated if desired.

The brace member 26 includes a substanitally flat upper wall 34 and a substantially flat lower wall 36. Sidewalls 38, 40 are angled and interconnect the upper and lower walls. The angle of the sidewalls is such as to provide a substantially right angle corner to complement the truncated face at the corner portion of the shelf.

A receiving pocket 42 is formed at the front end of the brace member and is defined by the upper, lower and sidewalls 34, 36, 38 and 40. The receiving pocket is substantially rectangular in shape and the base wall 30 also serves as the rear wall of the receiving pocket. The upper and lower walls 34, 36 include arcuate seats 44, 46 which are aligned and correspond in shape to the circumferential shape of the corner support posts 22.

The U-shaped clamp 28 includes the legs 48, 50 with an interconnecting bight portion 52. The upper surface 54 as well as the lower surface 56 are substantially flat. The terminal faces 58, 60 of the legs are also substantially flat. The height and width of the clamp is proximate the height and width of the receiving pocket 42 of the brace member, so that the clamp can fit within the receiving pocket and provide a substantially tight fit.

Clearance holes 62 are formed in the truncated face 24 of the shelf. Aligned clearance holes 64 are similarly formed in the base wall 30 of the brace member. Aligned threaded holes 66 are formed in the terminal faces of the legs of the U-shaped clamp. Fastening members, such as the bolts 68, can pass from the inside position through the holes 62 of the truncated face 24 and then pass through the aligned clearance holes 64 and finally be threaded into the threaded holes 66 in the U-shaped clamp.

The bight portion 52 of the clamp, and the aligned arcuate seats 44, 46 in the upper and lower wall of the brace member, define a sleeve which fits around the corner post 22. By means of the fastening bolts 68, the legs of the clamp are tightly pulled into the receiving pocket so that the sleeve closes tightly around the post to securely lock the corner connector 20 into position on the post. The bolts also serve to tightly pull the brace member against the truncated corner. In this manner, by tightening the bolts, the shelf is securely held in place on the corner posts.

Figure 4:
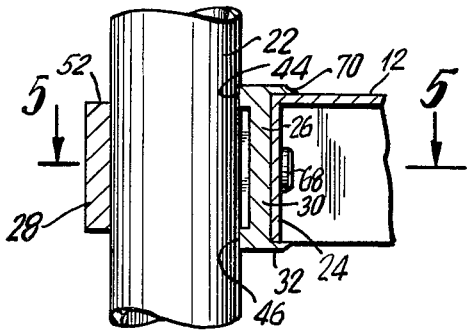
FIG. 4 is a side sectional view of the corner portion of the adjustable shelving clamped onto a corner post.
Figure 5:
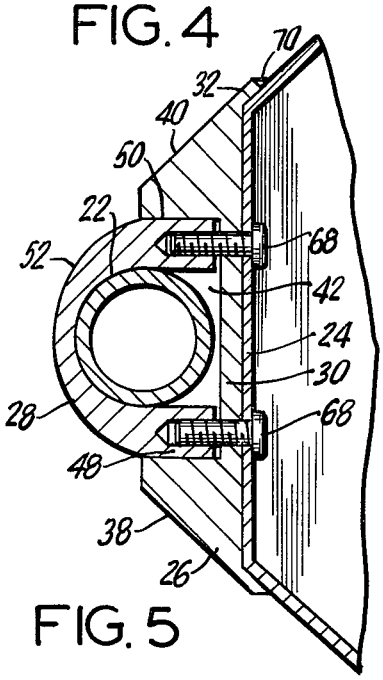
FIG. 5 is a sectional view taken along line 5—5 of FIG. 4.

With the corner connector assembled as shown in FIGS. 4 and 5, it is noted that the bight portion 52 of the clamp together with the arcuate surfaces 44, 46, form a tight enclosure around the post 22 to firmly clamp onto the rod 22. The brace member is securely held by means of the bolts 68 onto the corner of the shelf 12 with the truncated face 24 being held in close abutment to the base wall 30. The lips 32 overhang the top and bottom, or the top alone if modified as mentioned above, of the shelf 12 so that the face 24 fits into the recess formed by the lips 32. The edge of the lips can include a slight beveled portion 70. Preferably, as shown in FIG. 5, the length of the legs of the clamp is slightly shorter than the depth of the receiving pocket of the brace member, so that the bolts can securely hold the clamp around the post.

It should be appreciated from viewing FIGS. 4 and 5, that the clamping action is similar to that of a U-shaped bolt. However, all the parts fit together in such a manner that there are virtually no open joints, or crevices, which will permit dirt to accumulate therein. As a result, because of the particular construction of the various parts forming the corner connection in conjunction with the corner portion of the shelf, there is provided a sanitary interconnection which can be acceptable for use in the food service industry, as well as in the hospital service industry. Thus, the interconnection can be maintained clean and the accumulation of dirt in the crevices can be avoided.

Although the corner connections can be clamped directly onto the corner posts as heretofore described, in order to provide a series of vertical positions for adjusting the height of the shelf, there can be included on the posts a series of spaced apart indentations for establishing specific incremental vertical positions for the shelf. At the same time, on either the U-shaped clamp, or the brace member or on both, there can be included a projection which can engage the indentations and identify the particular vertical level of the shelf and hold it in place.

Figure 6:
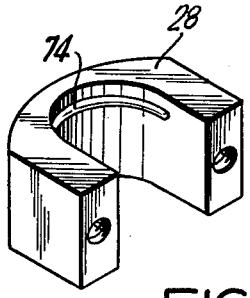
Figure 7:
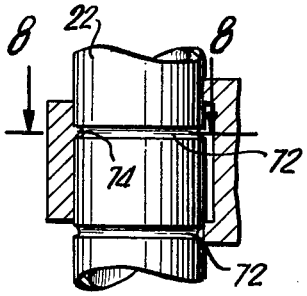
Figure 8:
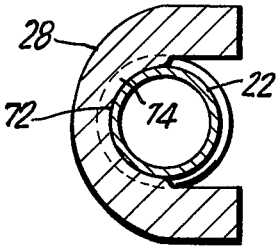

By way of example, FIGS. 6–8 show a first embodiment of the specific arrangement for controlling the adjustable vertical height. On the post 22, there are formed annular grooves 72 at incremental vertical positions along the length of the post. On the U-shaped clamp 28, there is included an arcuate rib 74 protruding outwardly from the inside surface of the bight portion. The arcuate rib acts as a partial retaining ring and fits into the annular groove 72, as can best be noted in FIGS. 7 and 8. When clamping the corner connector onto the post, the appropriate vertical level is selected and the arcuate rib is positioned so that it engages the annular groove at that level, and thereby will maintain the desired vertical position of the shelf along the post.

Figure 9:
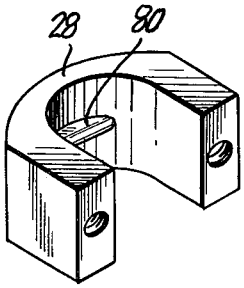
Figure 10:
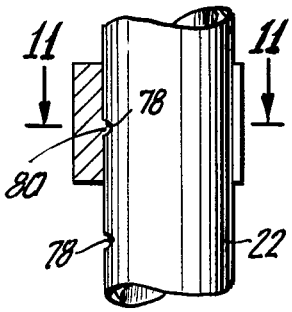
Figure 11:
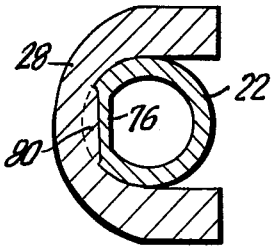

Referring to FIGS. 9–11, an alternate embodiment of the adjustable vertical leveling means is shown. In this case, the post 22 is indented at points 76 along one side thereof to form channels 78 therein extending in chordwise directions across the post. The channels 78 are vertically spaced apart to form a plurality of vertical positions along the post. In the U-shaped clamp 28, there is formed a chordally oriented protrusion or bar 80 extending from the inside surface of the bight and having a substantially semicircular cross section, as shown in FIG. 10. The protrusion 80 engages the channel 78 at the desired vertical height, and thereby maintains the vertical position of the shelf along the post.

Figure 12:
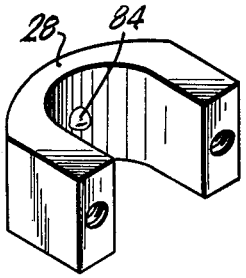
Figure 13:
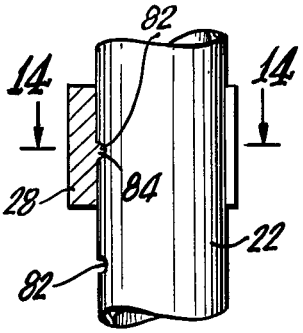
Figure 14:
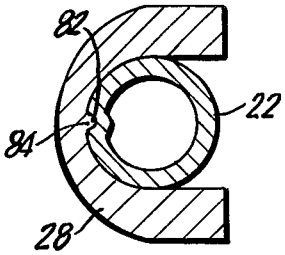

FIGS. 12–14 show a further embodiment of the adjustable vertical positioning. Detents 82 are formed in the post and vertically spaced one above the other. On the inside surface of the bight portion of the U-shaped clamp 28, there is a localized projection or dimple 84 of semispherical shape. The dimple 84 is arranged adjacent to the particular detent 82, at the vertical height desired and then clamped into position within the selected detent to maintain the vertical position of the shelf along the post.

Figure 15:
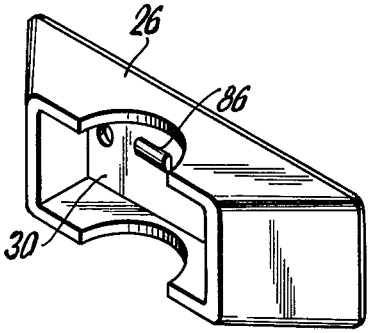
Figure 16:
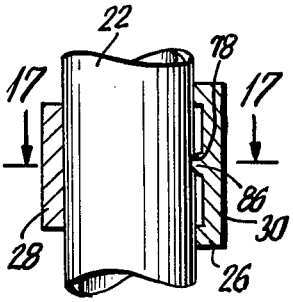
Figure 17:
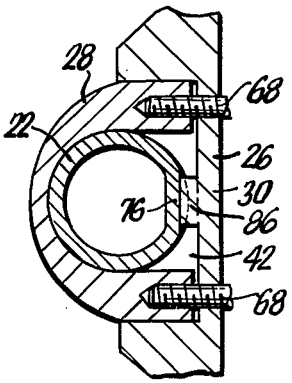

In addition to forming the projections on the U-shaped clamp, and specifically on the inside of the bight portion, similar projections may be provided on the base wall of the receiving pocket of the brace member. For example, as shown in FIGS. 16–17, there is again provided indented surfaces 76 on one side of the post 22 to provide channels 78 in a chordwise direction. The indentations shown are similar to those described in connection with FIGS. 10 and 11. However, in this embodiment, a protruding rib or bar 86 is formed on the base wall 30 of the receiving pocket 42 of the brace member 26, as shown in FIG. 15. The rib is semicylindrical in cross section and extends laterally across a portion of the base wall 30 proximate the center thereof. The rib 86 engages the channel 78 to determine the particular vertical height of the shelf along the post 22.

Figure 18:
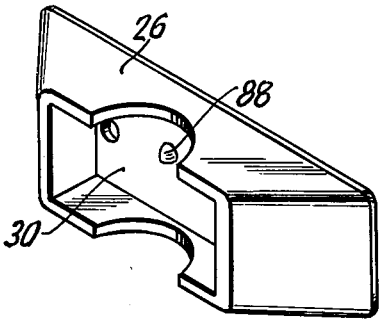
Figure 19:
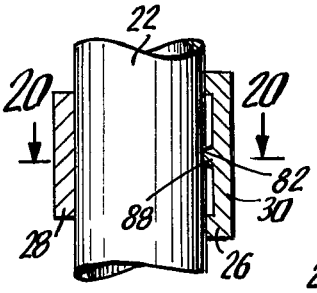
Figure 20:
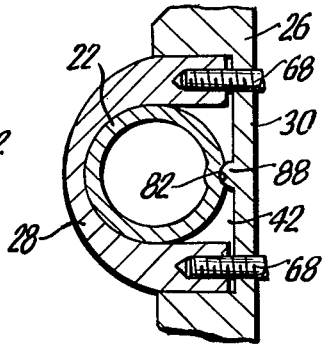

In a similar manner, FIGS. 18–20 show the use of a projection or dimple 88 formed on the base wall 30 of the receiving pocket 42 of the brace member 26. The projection fits into a detent 82 of the type shown in connection with FIGS. 13 and 14. By having the dimple 88 engage the detent 82, the particular vertical height of the shelf along the post 22 can be established.

Figure 21:
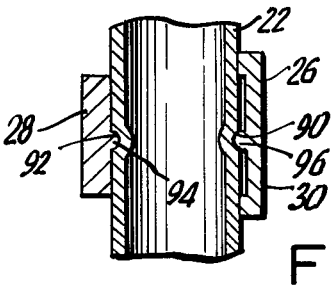
FIG. 21 is a side sectional view of a corner connector clamped onto a post, showing a combination of the various embodiments previously shown.

In addition to having the indentation, detent or channel on only one side of the post for engagement with a projection bar, rib or dimple on only one of either the brace member or the U-shaped clamp, it is possible to utilize such projections from both the brace member and the U-shaped clamp. As shown in FIG. 21, there is formed one indentation 90 on one side of the post 22 and a second indentation 92 on the diametrically opposite side of the post 22. The indentations 90, 92 can be any of the aforedescribed types including an annular recess, a detent, a channel, and the like. Corresponding thereto, there is formed a projection 94 on the clamp 28 and a projection 96 on the brace member 26. The projections can be also of the aforedescribed type and correspond to the particular type of indentation provided. For example, a dimple would be utilized to engage a detent, a rib would be utilized to engage a channel, and an arcuate rib or retaining ring would be utilized to engage an annular groove. The various forms can be mixed, as desired, in order to provide the appropriate locking arrangement to adjust the height at the particular vertical position along the post 22.

Although the shelf is shown as being a solid shelf, it is understood that various types of shelves could be utilized. For example, the shelves could be of the type having a series of bars, parallel wires, criss crossing wires, or any of the other types of shelves well known in the art.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Shelving comprising:

a flat shelf member having downwardly depending corner portions;

a corner connector at each corner portion, each connector comprising a brace member having a base wall disposed with a rear surface against an outside surface of the corner portion and a receiving pocket provided in a front surface of said brace member, said receiving pocket being defined by at least upper and lower walls of said brace member, aligned arcuate seats provided in said upper and lower walls, and a U-shaped clamp having a bight portion and spaced apart legs to be received in said pocket, said bight portion together with said aligned arcuate seats defining a sleeve for fitting around a corner support post;

fastening means for tightening said legs of said U-shaped clamp into said pocket of said brace member to clamp the sleeve about the post and for tightening said brace member in abutment against the corner portion of the shelf member to retain the shelf member in position on the post;

said base wall defining a rear wall of said receiving pocket, and said legs of said clamp having terminal faces which face the rear wall of the receiving pocket; and said corner portion and said base wall having aligned clearance holes, said terminal faces having threaded holes aligned with said clearance holes, said fastening means including bolts insertable from an inside surface of said corner portion through said clearance holes and into said threaded holes of said legs.

2. Shelving as in claim 1, wherein said brace member further comprises a peripheral lip surrounding said base wall to define a recess for receiving said corner portion of the shelf member therein.

3. Shelving as in claim 1, wherein said flat shelf member has truncated corners and said corner portions each extend across a truncated corner of said shelf member.

4. Shelving as in claim 3, wherein said upper and lower walls of said brace member are substantially horizontal, and wherein said receiving pocket is further defined by angled sidewalls of said brace member interconnecting said upper and lower walls, whereby said corner connector provides a substantially right angle corner onto the truncated corner of the shelf member.

5. Shelving as in claim 3, wherein said flat shelf member includes downwardly depending skirt portions, said corner portions providing a continuous interconnection between the skirt portions, and further including an inwardly directed flange at a lower edge of each skirt portion, each said flange terminating in a spaced relationship from said corner portions to thereby permit connection of said corner connectors to the corner portions.

6. Shelving as in claim 1, and further comprising corner support posts having a plurality of vertically spaced apart indentations, and wherein at least one of said clamp and said brace member includes an outwardly extending projection engageable within any one of the indentations for defining selectable vertical positions of the shelf member along the corner posts.

7. Shelving as in claim 6, wherein said indentations are annular grooves provided about the posts, and wherein said projection includes an arcuate rib provided on an inside surface of said bight portion of said U-shaped clamp.

8. Shelving as in claim 6, wherein said posts include indented surfaces provided on one side thereof, and wherein each of said indentations is a channel disposed in a chordwise direction across each indented surface.

9. Shelving as in claim 8, wherein said projection includes a chordally oriented rib provided on an inside surface of said bight portion of the U-shaped clamp.

10. Shelving as in claim 8, wherein said projection includes a rib extending from said rear wall of the receiving pocket, said rib having a semicircular cross sectional shape.

11. Shelving as in claim 6, wherein said indentations are detents provided in a vertical alignment along the posts.

12. Shelving as in claim 11, wherein said projection includes a semispherical dimple provided on an inside surface of the bight portion of the U-shaped clamp.

13. Shelving as in claim 11, wherein said projection includes a semispherical dimple provided on said rear wall of the receiving pocket.

14. Shelving as in claim 6, wherein said indentations are provided on both diametrically opposed sides of the posts, and wherein both said clamp and brace member include outwardly extending projections respectively engageable in the indentations on opposed sides of the post.

15. Shelving comprising:

a flat shelf member having downwardly depending corner portions;

a corner connector at each corner portion, each connector comprising a brace member having a base wall disposed with a rear surface against an outside surface of the corner portion and a receiving pocket provided in a front surface of said brace member, said receiving pocket being defined by at least upper and lower walls of said brace member, aligned arcuate seats provided in said upper and lower walls, and a U-shaped clamp having a bight portion and spaced apart legs to be received in said pocket, said bight portion together with said aligned arcuate seats defining a sleeve for fitting around a corner support post;

fastening means for tightening said legs of said U-shaped clamp into said pocket of said brace member to clamp the sleeve about the post and for tightening said brace member in abutment against the corner portion of the shelf member to retain the shelf member in position on the post;

an upper wall of said U-shaped clamp and the upper wall of said brace member being respectively substantially flat; and a height and a width of said clamp substantially corresponding to a height and a width of the receiving pocket to thereby provide a substantially crevice-free structure.

16. Shelving as in claim 15, wherein said brace member further comprises a peripheral lip surrounding said base wall to define a recess for receiving said corner portion of the shelf member therein.

17. Shelving as in claim 15, and further comprising corner support posts having a plurality of vertically spaced apart indentations, and wherein at least one of said clamp and said brace member includes an outwardly extending projection engageable within any one of the indentations for defining selectable vertical positions of the shelf member along the corner posts.

18. Shelving as in claim 17, wherein said indentations are annular grooves provided about the posts, and wherein said projection includes an arcuate rib provided on an inside surface of said bight portion of said U-shaped clamp.

19. Shelving as in claim 17, wherein said posts include indented surfaces provided on one side thereof, and wherein each of said indentations is a channel disposed in a chordwise direction across each indented surface.

20. Shelving as in claim 19, wherein said projection includes a chordally oriented rib provided on an inside surface of said bight portion of the U-shaped clamp.

21. Shelving as in claim 19, wherein said projection includes a rib extending from a rear wall of the receiving pocket, said rib having a semicircular cross sectional shape.

22. Shelving as in claim 17, wherein said indentations are detents provided in a vertical alignment along the posts.

23. Shelving as in claim 22, wherein said projection includes a semispherical dimple provided on an inside surface of the bight portion of the U-shaped clamp.

24. Shelving as in claim 22, wherein said projection includes a semispherical dimple provided on a rear wall of the receiving pocket.

25. Shelving as in claim 17, wherein said indentations are provided on both diametrically opposed sides of the posts, and wherein both said clamp and brace member include outwardly extending projections respectively engageable in the indentations on opposed sides of the post.

* * * * *